US005382266A

United States Patent [19]

Lin et al.

[11] Patent Number: 5,382,266

[45] Date of Patent: Jan. 17, 1995

[54] FUEL WITH STABILITY ADDITIVE AND PROCESS FOR STABILIZING FUEL USING AN ADDITIVE

[75] Inventors: Fan-Nan Lin; Filippo Pennella, both of Bartlesville, Okla.

[73] Assignee: Phillips Petroleum Company, Bartlesville, Okla.

[21] Appl. No.: 982,215

[22] Filed: Nov. 25, 1992

[51] Int. Cl.[6] ..... C10L 1/26

[52] U.S. Cl. ..... 44/382; 44/375; 44/435

[58] Field of Search ..... 44/375, 382, 435

[56] References Cited

U.S. PATENT DOCUMENTS

| | | | |
|---|---|---|---|
| 2,797,153 | 6/1957 | Bereslavsky | 44/435 |
| 3,074,230 | 1/1963 | De Vault | 60/35.4 |
| 3,099,691 | 7/1963 | Rauhut et al. | 44/435 |
| 3,115,465 | 12/1963 | Orloff et al. | 44/382 |
| 3,676,531 | 7/1972 | Spivack et al. | 44/378 |
| 4,572,374 | 6/1988 | Reid | 208/48 AA |
| 4,867,754 | 9/1989 | Reid | 44/382 |
| 5,114,436 | 5/1992 | Reid | 44/382 |

OTHER PUBLICATIONS

B. D. Batts and A. Zuhdan Fathoni, "A Literature Review on Fuel Stability Studies with Particular Emphasis on Diesel Oil"; *Energy and Fuels,* vol. 5, No. 1, (1991) pp. 2–21.

L. A. Beranek et al., "Rates of Indole-Phenaleone Reactions in Middle Distillate Fuel"; *Div. of Fuel Chemistry,* 35(4) ACS, Washington, D.C., 1990, pp. 1117–1124.

*Primary Examiner*—Ellen M. McAvoy

*Attorney, Agent, or Firm*—Ryan N. Cross

[57] ABSTRACT

The invention relates to inhibiting the degradation of fuel oils by the addition of phosphines and phosphites. Additionally, the invention relates to inhibiting the degradation of fuel oils by drying the fuel oil and adding phosphines and phosphites.

18 Claims, No Drawings

FUEL WITH STABILITY ADDITIVE AND PROCESS FOR STABILIZING FUEL USING AN ADDITIVE

BACKGROUND OF THE INVENTION

This invention relates to inhibiting distillate fuel oil fouling, manifested by color degradation, particulate formation and gum generation in distillate fuel oils.

During hydrocarbon processing, transportation and storage, the hydrocarbons deteriorate, particularly when subjected to elevated temperatures. The deterioration usually results in the formation of sediment, sludge, or gum and can manifest itself visibly by color deterioration. Sediment, sludge, or gum formation may cause clotting of the equipment or fouling of processing equipment, such as, for example, heat exchangers, compressors, furnaces, reactors and distillation systems. The fouling can be caused by the gradual accumulation of high molecular weight polymeric material on the inside surfaces of the equipment. As fouling continues, the efficiency of the operation associated with hydrocarbon processing equipment, such as heat exchangers, compressors, furnaces, reactors and distillation systems, decreases. The distillate streams which can result in significant fouling include the straight run distillates (kerosene, diesel, jet), naphthas, catalytic cracker feedstocks (gas oils), light and heavy cycle oils, coker naphthas, residual fuel oils, petrochemical plant feedstocks, and hydrotreated products of the above.

It is has been found that some types of color degradation, particulate formation and gum generation can be traced to the presence of indole species and certain phenol species in the fuel oils. It is believed that these species react and cause degradation of the fuel oil. Therefore, it is desirable to develop methods for preventing the reactions of these species and thus the degradation of the fuel oil.

SUMMARY OF THE INVENTION

It is, therefore, an object of the present invention to provide a process for inhibiting the degradation of fuel oil.

It is a further object of the present invention to provide a fuel oil composition which exhibits increased stability.

The above objects are realized in a process which comprises adding to a distillate fuel oil an effective inhibiting amount of a phosphine.

According to another embodiment, a process is provided which comprises drying a distillate fuel oil and adding an effective inhibiting amount of a stabilizing additive to the distillate fuel oil.

According to another aspect of the invention, there is provided a composition comprising a distillate fuel oil and a phosphine.

According to yet another aspect of the invention there is provided a composition comprising a dried fuel oil and a stabilizing additive.

DESCRIPTION OF THE PREFERRED EMBODIMENTS

The present invention pertains to the use of stabilizing additives, preferably phosphine antioxidants and phosphite antioxidants, in fuel oil in order to inhibit degradation of the fuel oil.

Degradation of the fuel oil, as used herein, refers to color degradation, particulate formation and/or gum generation.

According to the invention, a stabilizing additive is added to a fuel oil in order to inhibit degradation of the fuel oil. Preferably, these stabilizing additives are added prior to the degradation of the fuel oil. In another embodiment the fuel oil is dried and a stabilizing additive is added. While the stabilizing additive can be added either before or after drying of the fuel oil, it is preferred to first dry the fuel oil and then add the stabilizing additive. Drying can be accomplished by any suitable method, such as passing the fuel oil through an adsorption bed, fuel distillation, or by combining the fuel oil with an absorbent in a slurry. Preferred methods are the use of an adsorption bed or fuel distillation.

The stabilizing additive can be added to the distillate fuel oil by any conventional method. The stabilizing additive can be added either as a concentrate or as a solution using a suitable carrier solvent which is compatible with the additive and the fuel oil. The stabilizing additive can also be added at ambient temperature and pressure to stabilize the fuel oil during storage and prior to processing. The additive can be introduced into the equipment to be protected from fouling just upstream of the point of fouling. The stabilizing additives are preferably added to the fuel oil prior to any appreciable degradation of the fuel oil, as this will either eliminate degradation or effectively reduce the formation of particle matter and/or color degradation and eliminate or reduce subsequent fouling during processing. However, the mixture is also effective even after some degradation has occurred.

The stabilizing additives of this invention are antioxidants selected from the groups consisting of phosphite compounds having the formula:

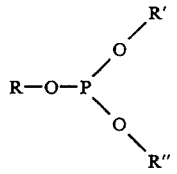

and phsophine compounds have the formula:

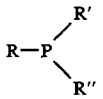

and mixtures of two or more thereof, wherein R, R′ and R″ are the same or different and are alkyl, aryl, alkaryl or aralkyl groups. Suitable examples of phosphite compounds include: triethylphosphite, triisopropylphosphite, triphenylphosphite, ethylhexyldiphenylphosphite, triisooctylphosphite, bis(2,4-di-t-butylphenyl)pentaerythritoldiphosphite, heptakis(dipropylene glycol)triphosphite, triisodecylophosphite, tris-nonylphenolphosphite, tristearylphosphite, tris-nonylphenylphosphite, trilaurylphosphite, 2,2′-ethylidene bis(4,6-butylphenyl)fluorophosphite, distearylpentaerythritoldiphosphite, diphenylisodecylphosphite, diphenylisoctylphosphite, poly(dipropylene glycol)phenylphosphite, diisooctyloctylphenylphosphite, tri(2,4-di-tert-butylphenyl)phosphite and diisodecylpentaerythritoldiphosphite. Suitable examples of phosphine compounds include: triethylphosphine, trixylylphosphine, tributylphosphine, dibutylphenylphosphine, methylethylbutylphosphine, dixylylphenylphosphine, dihexylmethylphosphine, triphenylphosphine, tri(2,4-di-tert-butylphenyl)phosphine, diethylpropylphosphine, 2-ethylphenylbutylhexylphosphine, trioctylphosphine, 2,2'-ethylidene bis(4,6-di-t-butylphenyl)phosphine, 2,3-dimethyltolyldiethylphosphine, dimethyldecylphosphine, bis(2,4-di-t-butylphenyl)pentaerythritoldiphosphine, 1-propylxylyldiphenylphosphine, tri-(1,3-dipropyl cresyl)phosphine, tris-nonylphenolphosphine, tritolylphosphine, triheyptylphosphine, triisopropylphosphine, tricresylphosphine, tritertiarybutylphosphine and diphenyltolylphosphine.

The preferred stabilizing additives are triphenylphosphite and triphenylphosphine and mixtures thereof.

The stabilizing additives should be added to said fuel oil in an effective inhibiting amount to either eliminate or effectively reduce degradation of the fuel oil. Generally, the amount will be in the range of from about 0.1 ppm to about 500 ppm, preferably from about 0.2 ppm to about 300 ppm, and most preferably from 0.5 ppm to 100 ppm.

The fuel oils of this invention are those fuel oils having hydrocarbon components distilling from about 100° F. to about 700° F. Included are straight run fuel oils, thermally cracked, catalytically cracked, thermally formed and catalytically formed oil stocks, naphthas, lube oils, light and heavy cycle oils, coker naphthas, residual fuel oils, petrochemical plant feedstocks, hydrotreated fuel oils thereof, and blends thereof which are susceptible to degradation and fouling. Preferably, the distillate fuel oil is a blend or mixture of fuels having hydrocarbon components distilled from about 200° F. to about 600° F.

The stabilizing additives of this invention have inhibited degradation of the fuel oil particularly well when indoles, and/or phenalenones are present in the fuel oil; therefore, preferably the fuel oil is one containing indoles and/or phenalenones.

Indoles, as used herein, refer to those compounds with the formula:

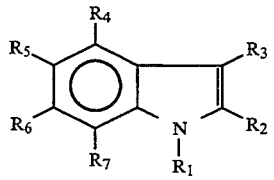

where $R_1$, $R_2$, $R_3$, $R_4$, $R_5$, $R_6$ and $R_7$ are hydrogen or alkyl, or aryl groups. Preferably the alkyl groups have 1 to 20 carbon atoms. Examples are indole, 2-methylindole, 3-methylindole, 2,3-dimethylindole, 2,5-dimethylindole, 1,2-dimethylindole and carbazone.

Phenalenones as used herein refer to those compounds with the formula:

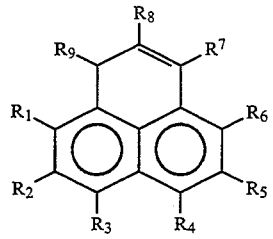

or

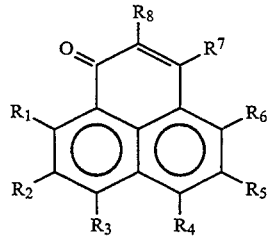

where $R_1$, $R_2$, $R_3$, $R_4$, $R_5$, $R_6$, $R_7$, $R_8$, and $R_9$ are hydrogen or alkyl groups. Preferably, the alkyl groups have 1 to 20 carbon atoms. Examples are phenylene, and phenalenone.

Preferably, indole, phenylenone and/or phenalene are present in the fuel oil.

In order to more clearly illustrate his invention the data set forth below was developed. The following examples are included as being illustrations of the invention and should not be construed as limiting the scope thereof.

EXAMPLES

In the following examples, fuel degradation was measured by correlating it to color change as measured by ultraviolet light (UV) absorption at 395 nm wavelength. The fuels were tested for initial color by measuring the absorption at 395 nm. They then underwent accelerated aging. Afterwards, they were re-tested for color. The difference between the initial absorption at 395 nm and the absorption after aging was recorded as the color change.

To perform the accelerated aging, 5 gm of sample were placed in a 18 cc glass vial with the vial cap being loosely held to expose the sample to air. The aging was done at 80° C. in a Pierce Reacti-Thermal heating module which was equipped with a 9-hole aluminum heating block.

The UV-absorbance spectra were obtained using a Milton-Roy spectrophotometer, Model Spectronic 1201.

In the examples, a kerosene, jet fuel oil was used containing 47.2 wt. % paraffins, 36.4 wet. % naphthenes, 16.4 wt. % aromatics, 0.0 wt. % sulfur. Additionally, no phenalenones and indoles were detected.

CONTROL I

Four samples of kerosene, jet fuel oil were doped with 1000 ppm di-naphthenebenzene (1000 DNB), 70 ppm Indole (70 IN), 3.2 ppm phenalenone (3.2 P) and 1.6 ppm phenalenone along with 35 ppm indole (1.6 p+35 IN), respectively. The samples were tested for UV-absorption at 395 nm, followed by accelerated 10 day aging, and then re-testing. Color change was determined by comparing the pre-aging test with the post-aging test. The results are shown in Table I.

EXAMPLE A

Four samples of kerosene, jet fuel oil were doped as in Control I. The samples were then spiked with 5 ppm of triphenylphosphite (TPPT). Next, the samples were tested and aged as in Control I. The results are shown in Table I.

EXAMPLE B

Four samples of kerosene, jet fuel oil were doped as in Control I. The samples were then spiked with 5 ppm of triphenylphosphine (TPPN). Next, the samples were tested and aged as in Control I. The results are shown in Table I.

EXAMPLE C

Example B was repeated, except that only 1 ppm of triphenylphosphine was used. The results are shown in Table I.

TABLE I

| | | Color Change | | | |
|---|---|---|---|---|---|
| Additive | Amount | 1000 DNB Sample | 70 IN Sample | 3.2 P Sample | 1.6 P + 35 IN Sample |
| — | — | 0.030 | 0.099 | 0.036 | 0.103 |
| TPPT | 5 ppm | 0.031 | −0.004* | 0.058 | 0.041 |
| TPPN | 5 ppm | 0.031 | 0.002 | 0.019 | 0.014 |
| TPPN | 1 ppm | 0.028 | −0.001* | 0.021 | 0.020 |

*Although a negative value was recorded, these values are within experimental error of 0.

Table I illustrates the improved stability of fuel oil when a stabilizing additive, according to this invention, is added, especially when phenalenones and indoles are present.

CONTROL II

Kerosene, jet fuel was tested for UV-absorption at 395 nm. Next, the jet fuel was accelerated aged for 7 days and re-tested for UV-absorption. The jet fuel was accelerated aged for an additional 7 days and tested a third time for UV-absorption. The 7-day and 14-day UV-absorption tests were compared to the initial test and the differences were recorded as the color change. The results are recorded in Table II.

EXAMPLE D

The kerosene, jet fuel was spiked with 0.6 ppm triphenylphosphine and then tested and aged as in Control II. The results are recorded in Table II.

EXAMPLE E

The kerosene, jet fuel was first dried with a 5A molecular sieve from Davidson Corporation. The sieve was a 20/40 mesh and was vacuum dried at 100° C. for 2 hours. The dried fuel was then spiked with 0.6 ppm triphenylphosphine. Afterwards it was tested and aged as in Control II. The results are recorded in Table II.

TABLE II

| Absorption | Tri-phenylphosphine (ppm) | Color Change After Aging 7 Days | Color Change After Aging 14 Days |
|---|---|---|---|
| No | — | 0.012 | 0.037 |
| No | 0.6 | 0.017 | 0.060 |
| Yes | 0.6 | 0.002 | 0.007 |

Table II illustrates the superior results obtained when fuel oil is dried in addition to adding a stabilizing additive. In Table II the low concentration of additive (0.6 ppm) did not result in a reduction in fuel degradation by itself; however, when the fuel was dried and a stabilizing additive added, a substantial reduction in fuel degradation was achieved.

CONTROL III

Kerosene, jet fuel was doped with 35 ppm indole and 1.6 ppm phenalenone, and then aged and tested as in Control II. The results are shown in Table III.

EXAMPLE F

Kerosene, jet fuel was doped with 35 ppm indole and 1.6 ppm phenalenone. To the doped jet fuel was added 0.6 ppm triphenylphosphine. Finally, the fuel was aged and tested as in Control II. The results are shown in Table III.

EXAMPLE G

Kerosene, jet fuel was doped with 35 ppm indole and 1.6 ppm phenalenone. The doped jet fuel was dried as in Example E and then spiked with 0.6 ppm triphenylphosphine. Finally, the fuel was aged and tested as in Control II. The results are shown in Table III.

TABLE III

| Absorption | Tri-phenylphosphine (ppm) | Color Change After Aging 7 Days | Color Change After Aging 14 Days |
|---|---|---|---|
| no | — | 0.112 | 0.170 |
| no | 0.6 | 0.046 | 0.102 |
| yes | 0.6 | 0.013 | 0.021 |

Table III illustrates that the stabilizing additive has a profound effect on fuel degradation when indoles and phenalenone are present and that drying of the fuel can result in even further reduction of degradation.

The above examples illustrate that the stabilizing additives of this invention reduce the degradation of fuel oils. Additionally, they show that when a fuel oil is dried in addition to adding a stabilizing additive, a further reduction in fuel oil degradation can be achieved.

While this invention has been described with respect to particular embodiments thereof, it is apparent that numerous other forms and modifications of this invention will be obvious of those skilled in the art. The appended claims in this invention generally should be construed to cover all modifications which are within the true spirit and scope of the present invention.

That which is claimed is:

1. Process for inhibiting the degradation of a fuel oil which comprises:

a) drying said fuel oil; and b) adding to said fuel oil and effective inhibiting amount of a stabilizing additive.

2. A process according to claim 1 wherein said stabilizing additive is selected from the group consisting of phosphine compounds having the formula:

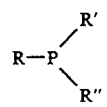

and phosphite compounds having the formula:

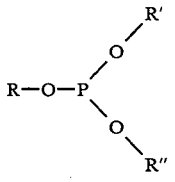

and mixtures of two or more thereof, wherein R, R′ and R″ are the same or different and are alkyl, aryl, alkaryl or aralkyl groups.

3. A process according to claim 2 wherein said stabilizing additive is present in an amount from about 0.1 ppm to about 500 ppm.

4. A process according to claim 2 wherein said stabilizing additive is present in an amount from about 0.2 ppm to about 300 ppm.

5. A process according to claim 1 wherein said stabilizing additive is triphenylphosphine.

6. A process according to claim 1 wherein said stabilizing additive is triphenylphosphite.

7. A process according to claim 1 wherein said distillate fuel oil contains a compound selected from the group of indoles, phenalenones, and mixtures of two or more thereof.

8. A process according to claim 1 wherein said stabilizing additive is added to said fuel oil prior to deterioration of said distillate fuel oil.

9. A process according to claim 1 wherein said drying is accomplished by passing said fuel oil through an absorbent bed.

10. A process according to claim 1 wherein said drying is accomplished by distillation.

11. A process for inhibiting the degradation of a fuel oil containing a compound selected from the group of indoles, phenalenones, and mixtures of two or more thereof comprising:

(a) drying said fuel oil to produce a dried fuel;

(b) adding to said dried fuel an amount of a stabilizing additive selected from the group of triphenylphosphine, triphenylphosphite and mixtures thereof, in the range of from 0.5 ppm to 100 ppm.

12. A composition comprising a dried distillate fuel oil and a stabilizing additive.

13. A composition comprising a dried distillate fuel oil and a stabilizing additive selected from the group consisting of phosphine compounds having the formula:

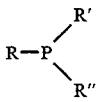

and phosphite compounds have the formula:

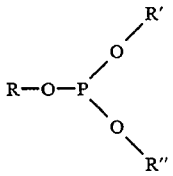

and mixtures of two or more thereof, where R, R′ and R″ are the same or different and are alkyl, aryl, alkaryl or aralkyl groups.

14. A composition according to claim 13, wherein said stabilizing additive is triphenylphosphine.

15. A composition according to claim 13 wherein said stabilizing additive is triphenylphosphite.

16. A composition according to claim 13 wherein said dried fuel oil contains indoles, phenalenones, and mixtures of two or more thereof.

17. A composition according to claim 13 wherein said stabilizing additive is present in the amount of from about 0.1 ppm to about 500 ppm.

18. A composition according to claim 13 wherein said stabilizing additive is present in the amount of from 0.5 ppm to 100 ppm.

* * * * *